United States Patent [19]

Jarman et al.

[11] 4,324,125

[45] Apr. 13, 1982

[54] AUTO BODY CLAMP

[76] Inventors: Davis R. Jarman; Virgil H. Hinson, both of Box 113, Rte. 3, Brunswick, Ga. 31520

[21] Appl. No.: 92,921

[22] Filed: Nov. 9, 1979

[51] Int. Cl.[3] ..... B21D 1/12; A44B 21/00

[52] U.S. Cl. ..... 72/479; 72/705; 24/248 R; 24/251; 24/263 B; 294/106

[58] Field of Search ..... 72/705, 300, 457, 479; 254/18, 24; 279/1 GS, 24, 28, 107; 24/248 R, 248 B, 248 E, 248 SA, 251, 263 R, 263 SW, 263 SB, 263 B; 294/102, 86.16, 96, 106, 86.17, 94, 97, 124

[56] References Cited

U.S. PATENT DOCUMENTS

| | | | |
|---|---|---|---|
| 222,112 | 11/1879 | Wilson | 254/18 |
| 579022 | 3/1897 | Snediker | 269/239 X |
| 816,777 | 4/1906 | Brown | 24/251 UX |
| 1,322,920 | 11/1919 | Malbon | 294/116 |
| 1,376,614 | 5/1921 | Foster | 24/251 |
| 1,538,416 | 5/1925 | McCarty | 294/116 |
| 2,214,524 | 9/1940 | Deming | 24/250 |
| 2,602,690 | 7/1952 | Meighan | 24/251 |
| 2,817,492 | 12/1957 | Case | 294/116 X |
| 2,990,961 | 7/1961 | Schneider | 24/251 X |
| 3,576,057 | 4/1971 | Hoy | 24/263 R |
| 3,744,686 | 7/1973 | Levitin | 24/248 SA |
| 3,827,279 | 8/1974 | Buske | 72/705 |
| 3,896,526 | 7/1975 | Joiner | 24/251 |
| 3,941,363 | 3/1976 | Ogg | 269/237 X |
| 3,986,746 | 10/1976 | Chartier | 294/116 |

FOREIGN PATENT DOCUMENTS

| | | | |
|---|---|---|---|
| 2535482 | 2/1976 | Fed. Rep. of Germany | 254/18 |
| 2735553 | 2/1978 | Fed. Rep. of Germany | 72/705 |
| 53283 | 1/1967 | German Democratic Rep. | 294/102 |

*Primary Examiner*—Lowell A. Larson

*Attorney, Agent, or Firm*—Harvey B. Jacobson

[57] ABSTRACT

An elongated base is provided including a pair of opposite side opposing abutment surfaces disposed in a plane extending therebetween transversely of the base. A pair of elongated longitudinal side-by-side levers are disposed between the abutment surfaces and include opposite end portions projecting from opposite sides of the aforementioned plane. A first pair of end portions define opposing jaw faces for clamping an auto body portion therebetween and anchor structure is carried by the base for applying a pulling force thereon in a direction opposite to the direction in which the first end portions project. Wedge structure is shiftably supported from the base between the second end portions of the levers and operable to selectively wedge the second end portions apart and thereby cause the levers to fulcrum on the abutment surfaces to swing the first pair of end portions toward each other. The levers are slightly relatively angulated with the remote surfaces thereof slightly divergent toward the second end portions and the levers are slidably engageable with the abutment surfaces to cam the first pair of end portions of the levers toward each other in response to longitudinal shifting of the levers and the wedge structure relative to the base in a direction advancing the first end portions.

11 Claims, 5 Drawing Figures

AUTO BODY CLAMP

BACKGROUND OF THE INVENTION

Various forms of auto body component engaging clamps heretofore have been provided and some of these clamps include structure whereby the clamping force on the auto body component engaged thereby is increased as tension is applied to the clamp. While these previously known forms of clamps are operative in various different auto body straightening situations and are adjustable, at least to some degree, as to the thickness of the workpiece which may be clamped between the jaw portions thereof, these previously known forms of clamps may not have the clamping forces exerted thereby released independent of the pulling force on the clamp being released. Further, some clamps of this type are not readily adjustable to the thickness of work to be clamped thereby and are not constructed in a manner whereby the clamp may be quickly engaged with the workpiece independent of a pulling force being applied to the clamp.

Accordingly, a need exists for an auto body clamp whose clamping action may be released independent of release of pulling force on the clamp, a clamp constructed in a manner whereby the clamping action on the desired auto body component may be readily effected independent of a pulling force being applied to the clamp and a clamp operable in a manner such that the clamp may be readily adjusted to accommodate auto body component parts of different thicknesses.

Examples of previously known forms of auto body clamps including some of the general structural and operational features of the instant invention are disclosed in U.S. Pat. Nos. 3,744,838, 3,835,693, 3,955,249 and 4,148,210.

BRIEF DESCRIPTION OF THE INVENTION

The clamp of the instant invention includes a pair of elongated jaws between one pair of ends of which a wedge structure is supported. A pair of spaced apart relatively rigidly supported abutment surfaces embrace the other pair of ends of the jaws from the remote sides thereof and the jaws and wedge structure are also longitudinally displaceable relative to the abutment surfaces. By actuating the wedge structure to wedge the first pair of ends of the jaws apart, the levers are fulcrumed aboout the abutment surfaces to swing the second work engaging ends of the jaws into clamped engagement with the workpiece disposed therebetween and the opposing surfaces of the jaws slidably engaged with the abutment surfaces are slightly divergent away from the work engaging ends of the jaws so that when the jaws and wedge structure are longitudinally displaced relative to the abutment surfaces, the work engaging ends of the jaws or levers are caused to shift into tighter clamped engagement with the associated workpiece.

The main object of this invention is to provide an auto body component gripping clamp including structure whereby the clamp may be readily adjusted for different thicknesses of auto body portions to be clampingly engaged thereby.

Yet another object of this invention is to provide an auto body component clamp constructed in a manner whereby the clamping action on an associated auto body component will be automatically increased as tension is applied to the clamp, but with the clamp including structure whereby the clamping action thereof may be released independent of release of tension on the clamp.

Another very important object of this invention is to provide an auto body clamp constructed in a manner whereby it will automatically increase the clamping action thereof on an auto body component as tension is applied to the clamp but also including structure whereby the clamp may be initially engaged with an auto body component independent of tension being applied to the clamp.

A final object of this invention to be specifically enumerated herein is to provide an auto body clamp in accordance with the preceding objects and which will conform to conventional forms of manufacture, be of simple construction and easy to use so as to provide a device that will be economically feasible long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
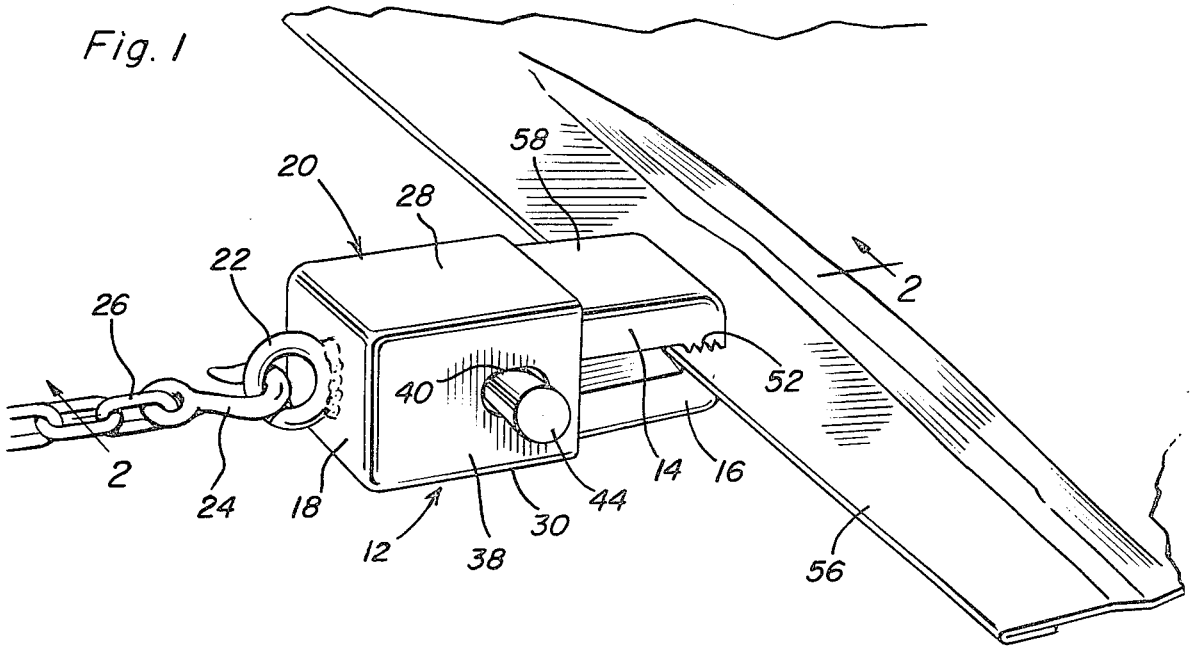
FIG. 1 is a perspective view of the auto body clamp of the instant invention operatively associated with an auto body sheet metal component.
Figure 2:
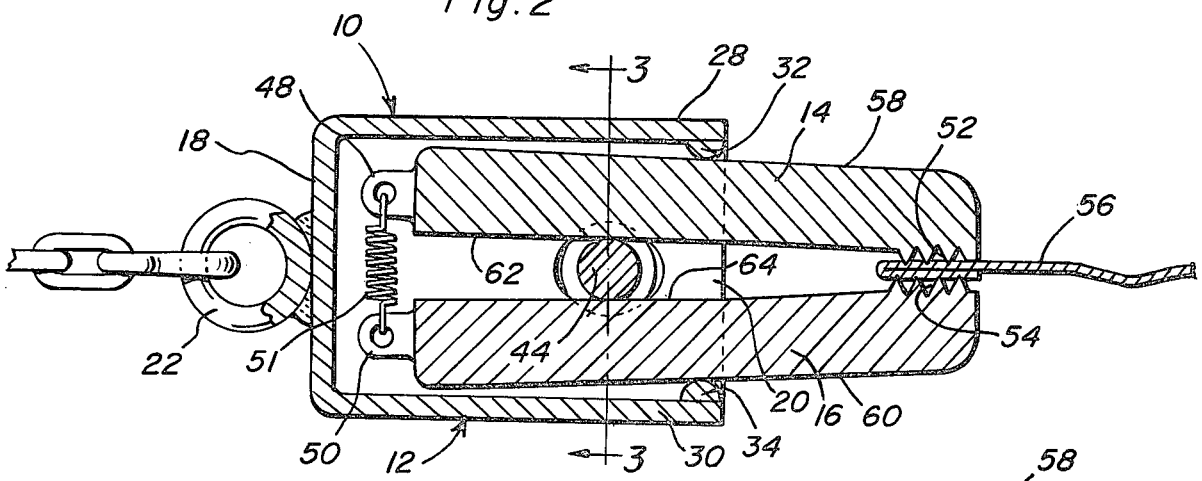
FIG. 2 is a fragmentary enlarged vertical sectional view taken substantially upon the plane indicated by the section line 2—2 of FIG. 1.

Referring now more specifically to the drawings, the numeral 10 generally designates the clamp of the instant invention. The clamp 10 includes a housing or base component 12 and a pair of elongated jaws 14 and 16. The housing 12 comprises a rectangular tubular housing having an end wall 18 closing one end thereof and open at the its other end 20. The end wall 18 has an anchor 22 supported therefrom and a hook member 24 carried by one end of an elongated tension member 26 may be readily releasably engaged with the anchor 22 whenever desired.

The housing or base 12 includes upper and lower walls 28 and 30 and the ends of the walls 28 and 30 at the open end 20 of the housing 12 include inwardly projecting abutments 32 and 34.

The housing 12 further includes a pair of opposite side walls 36 and 38 having elongated slots 40 and 42 formed therein and a tapered cylindrical wedge pin 44 has its opposite ends loosely received through the slots 40 and 42, the larger diameter end of the wedge pin 44 being too large in diameter to be received through the slot 42 and the smaller diameter end of the wedge pin 44 having a diametrically enlarged head 46 removably secured thereto preventing withdrawal of the small diameter end of the pin 44 through the slot 40.

The wedge pin 44 is received between the rear end portions of the jaws 14 and 16 disposed within the housing 12 and is spaced slightly rearwardly of a transverse plane containing the abutments 32 and 34. The rear ends of the jaws or levers 14 and 16 include apertured mounting lugs 48 and 50 to which opposite ends of a coiled expansion spring 51 are anchored and the forward ends of the jaws or levers 14 and 16 include arcuate serrated opposing jaw faces 52 and 54 between which the folded marginal edge portion of an auto body sheet metal component 56 is clamped.

The levers or jaws 14 and 16 include remote longitudinal surfaces 58 and 60 slidably engaged with the abutments 32 and 34 and adjacent longitudinal surfaces 62 and 64, slightly bevelled to match the taper of the wedge pin 44, against which the wedge pin 44 is engageable and which are slidable along the wedge pin 44.

When it is desired to engage the clamp 10 with the sheet metal component 56, the wedge pin 44 is axially displaced to a position with its removable enlarged head 46 abutted against the outer side of the side wall 36. This reduces the thickness of the portion of the wedge pin 44 disposed between the opposing longitudinal surfaces 62 and 64 of the levers 14 and 16 and thus enables the spring 51 to pull the rear ends of the jaws or levers 14 closer to each other thus rocking the levers 14 and 16 about the wedge pin 44 to spread the forward ends of the levers 14 and 16 apart. The serrated faces 52 and 54 of the levers 14 and 16 may then be positioned on opposite sides of the sheet metal component 56 and, with the levers 14 and 16 in substantially their rearmost positions within the housing 12, the larger diameter end of the wedge pin 44 is struck sharply with an impact tool in order to spread the rear ends of the levers 14 and 16 apart and thus to fulcrum the levers 14 and 16 on the abutments 32 and 34 in order to swing the serrated jaws 52 and 54 of the levers 14 and 16 into tight engagement with opposite sides of the sheet metal portion 56. Thus, the clamp 10 may be clampingly engaged with the sheet metal portion 56 independent of tension being applied to the clamp through the utilization of the tension member 26 and hook member 24. However, after the hook member 24 has been engaged with the anchor 22 and tension is applied to the tension member 26, the housing 12 is displaced to the left relative to the sheet metal component 56 and the surfaces 62 and 64 slide relative to the wedge pin 44 while the surfaces 58 and 60 slide relative to the abutments 32 and 34, the surfaces 58 and 60 being slightly rearwardly divergent whereby longitudinal shifting of the levers 14 and 16 in a forward direction relative to the housing 12 causes the abutments 32 and 34 to function as sliding wedges and to cam the forward ends of the levers 14 and 16 together about the wedge pin 44 to thus cause the serrated jaws 52 and 54 to more tightly grip the sheet metal component 56 as tension is applied.

Figure 3:
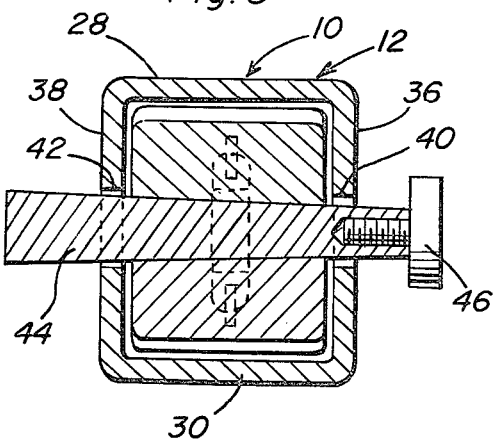
FIG. 3 is a transverse vertical sectional view taken substantially upon the plane indicated by the section line 3—3 of FIG. 2.
Figure 4:
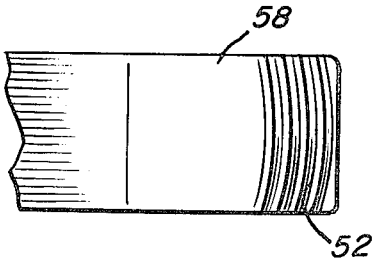
FIG. 4 is a fragmentary face view of one of the workpiece engaging jaws of the clamp.
Figure 5:
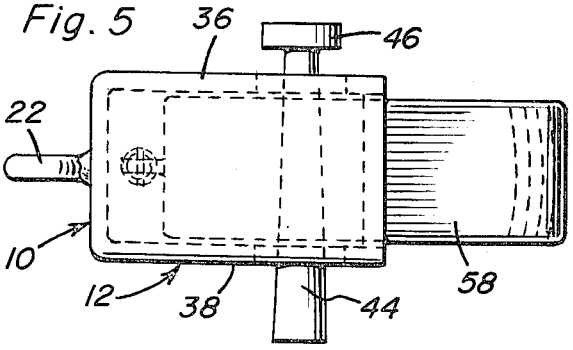
FIG. 5 is a top plan view of the clamp.

Even when tension is applied to the tension member 26, the removable head 56 on the small end of the wedge pin 44 may be struck with an impact member to automatically release the jaws 14 and 16 from clamped engagement with the sheet metal component 56 independent of release of tension on the tension member 26. Thus, the wedge pin 44 serves not only to initially clamp the sheet metal component 56 between the forward ends of the levers 14 and 16 when the wedge pin 44 is shifted to the right as view in FIG. 3 before tension is applied to the tension member 26, but also enables the clamp 10 to be disengaged from the sheet metal component 56 by shifting of the wedge pin 44 to the left as viewed in FIG. 3 independent of release of tension on the tension member 26.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An auto body gripping clamp including a base component defining a pair of spaced opposing abutment surfaces, a pair of elongated levers laterally facing each other and including first and second pairs of corresponding end portions projecting in opposite directions from opposite sides of a plane transverse to said levers and containing said abutment surfaces, said levers being supported from said base component for longitudinal shifting relative thereto, said first pair of end portions projecting from one side of said plane defining opposing jaw faces for clamping an auto body portion therebetween, means carried by said base component for attaching a pull member thereto for applying a pulling force thereon in a direction opposite to the direction in which said first pair of end portions project, said levers including pairs of remote and adjacent longitudinal surfaces, wedge means shiftably supported from said base component on the other side of said plane between said adjacent surfaces of said levers for selectively wedging said second pair of end portions apart and shifting of said wedge means with said levers longitudinally of said base, said remote surfaces being slightly divergent toward said second end portions when said second end portions are wedged apart by said wedge means, said remote surfaces being slidably engageable with said abutment surfaces to cam said first pair of end portions toward each other upon shifting of said levers and said wedge means relative to said base component longitudinal direction of said levers in which said first end portions thereof project, said base component comprising a tubular housing having a first open end from which said first pair of end portions project, said abutment surfaces being supported from opposite side portions of said tubular housing adjacent said open end thereof, said wedge means comprising a longitudinally tapered elongated wedge extending transversely of said levers and housing and including opposite side longitudinal convergent wedge surfaces shiftable lengthwise and transversely between said adjacent surfaces with said wedge surfaces opposing and engaging said adjacent surfaces and the opposite ends of said wedge projecting through opposite side portions of said housing.

2. The combination of claim 1 wherein said opposite side portions of said housing include elongated slots formed therein extending longitudinally of said housing and through which the opposite ends of said wedge project.

3. The combination of claim 2 wherein said adjacent surfaces are transversely inclined at an angle corresponding to the angle of the taper of said wedge.

4. An auto body gripping clamp including a base component defining a pair of spaced opposing abutment surfaces, a pair of elongated levers laterally facing each other and including first and second pairs of corresponding end portions projecting in opposite directions from opposite sides of a plane transverse to said levers and containing said abutment surfaces, said levers being supported from said base component for longitudinal shifting relative thereto, said first pair of end portions projecting from one side of said plane defining opposing jaw faces for clamping an auto body portion therebetween, means carried by said base component for attaching a pull member thereto for applying a pulling force thereon in a direction opposite to the direction in which said first pair of end portions project, said levers including pairs of remote and adjacent longitudinal surfaces, wedge means shiftably supported from said base component on the other side of said plane between said adjacent surfaces of said levers for selectively wedging said second pair of end portions apart and shifting of said wedge means with said levers relative to said base, said remote surfaces being slightly divergent toward said second end portions when said second end portions are wedged apart by said wedge means, said remote surfaces being slidably engageable with said abutment surfaces to cam said first pair of end portions toward each other upon shifting of said levers and said wedge means relative to said base component in longitudinal direction of said levers in which said first end portions thereof project, said wedge means comprises a longitudinally tapered elongated wedge including opposite side longitudinal convergent wedge surfaces shiftable lengthwise and transversely between and with said wedge surfaces opposing said adjacent surfaces.

5. The combination of claim 4 wherein said base component comprises a tubular housing having a first open end from which said first pair of end portions project, said opposite side portions of said housing including elongated slots formed therein extending longitudinally of said housing and through which the opposite ends of said wedge project.

6. The combination of claim 5 wherein said adjacent surfaces are transversely inclined at an angle corresponding to the angle of the taper of said wedge.

7. The combination of claim 6 wherein said jaw faces include meshing transverse serrations.

8. The combination of claim 7 wherein said serrations are elongated, arcuate and extend transversely of said first pair of end portions.

9. An auto body gripping clamp including an elongated base defining a pair of spaced opposing opposite side abutments at one end, a pair of elongated levers laterally facing each other and disposed between said abutments and including remote longitudinal surfaces slidably engaged with said abutments and slightly divergent toward one pair of lever ends, said lever also including adjacaent opposing longitudinal surfaces, the other pair of lever ends defining opposing jaw faces, and wedge structure shiftable longitudinally of said base and relative to said levers for wedging the one pair of lever ends apart, said wedge structure comprising a longitudinally tapered elongated wedge extending transversely of said levers and base and including opposite side longitudinal convergent wedge surfaces and shiftable lengthwise and transversely between said adjacent surfaces with the latter slidably engaged by said wedge surfaces.

10. An auto body gripping clamp including an elongated base defining a pair of spaced opposite side abutments at one end, a pair of elongated longitudinally extending and laterally spaced apart levers disposed between said abutments, longitudinally shiftable relative to said base and including remote longitudinal surfaces slidably engaged with said abutments intermediate the opposite ends of said levers and laterally spaced opposing adjacent longitudinal surfaces, said remote surfaces being slightly convergent toward one pair of lever ends, said one pair of ends defining opposing jaw faces, and wedge structure operatively associated with said levers between the other pair of ends thereof on the side of a transverse plane containing said abutments remote from said one jaw ends and operative, in conjunction with said abutments, to support said levers relative to each other for relative angular displacement to force said one ends toward each other in response to lengthwise shifting of said levers relative to said base to longitudinally advance said one jaw ends, said wedge comprising a longitudinally tapered elongated wedge extending transversely of said levers and base and including opposite side longitudinal convergent wedge surfaces and shiftable lengthwise and transversely between said adjacent surfaces with the latter slidingly engaged by said wedge surfaces.

11. The combination of claim 10 wherein said one ends of said levers project endwise outwardly of said one end of said base and said other end of said base includes means for anchoring one end of an elongated tension member thereto.

* * * * *